United States Patent [19]

Ferraro

[11] 3,952,413

[45] Apr. 27, 1976

[54] SHAVING UNIT FOR SAFETY RAZOR

[75] Inventor: Frank A. Ferraro, Trumbull, Conn.

[73] Assignee: Warner-Lambert Company, Morris Plains, N.J.

[22] Filed: Dec. 13, 1974

[21] Appl. No.: 532,430

[52] U.S. Cl. ..... 30/346.58

[51] Int. Cl.[2] ..... B26B 21/54

[58] Field of Search..... 30/50, 346.57, 346.58, 30/346.59, 346.61; 219/87; 228/185

[56] References Cited

UNITED STATES PATENTS

| | | | |
|---|---|---|---|
| 2,133,018 | 10/1938 | Cahill | 30/346.61 |
| 2,439,233 | 4/1948 | Yingling | 219/87 |
| 3,851,392 | 12/1974 | Donovan | 30/346.58 |

*Primary Examiner*—Al Lawrence Smith
*Assistant Examiner*—Gary L. Smith
*Attorney, Agent, or Firm*—Albert H. Graddis; Jeremiah J. Duggan

[57] ABSTRACT

The specific disclosure provides a shaving unit having two flexible double edge razor blades with the cutting edges of the top blade being set back a slight distance from the cutting edges of the bottom blade. Each one of the blades has a pair of transversely spaced end tabs. The blades are vertically separated by a spacer, and a transversely elongated aperture extends through the blades and the spacer between the end tabs for locating the shaving unit in a double edge safety razor. First means are provided between the aperture and the cutting edges to each side of the aperture for permanently connecting the top blade to the spacer, and second means are provided outwardly in the direction of each bottom blade end tab from the first connecting means and between the aperture and the cutting edges to each side of the aperture for permanently connecting the bottom blade to the spacer. A transversely elongated perforation is formed in the spacer between the first and second connecting means and the cutting edges to each side of the aperture.

9 Claims, 3 Drawing Figures

SHAVING UNIT FOR SAFETY RAZOR

BACKGROUND OF THE INVENTION

1. Field of the Invention

The present invention relates to shaving units having a plurality of cutting edges for use in a safety razor. More particularly, the present invention relates to safety razor shaving units having a plurality of double cutting edge members bonded together.

2. Description of the Prior Art

Double edge safety razors are well-known in the art, and are in many forms. For example, U.S. Pat. Nos. 3,293,745, 3,466,746 and 3,708,879 disclose a razor having sectional caps, an adjustable razor and a razor having a hinged cap, respectively. Such razors act to clamp a thin, flexible double edge razor blade in the razor head with each cutting edge oriented with respect to a guard bar surface.

U.K. Pat. No. 772,532 discloses a shaving unit having two double edge razor blades which are vertically separated by a flexible spacer. The cutting edges of the top blade are set back a slight distance from the cutting edges of the bottom blade to provide tandemly arranged cutting edges on each side of the shaving unit.

U.K. Pat. No. 772,532 contemplates welding the blades and spacer together, and, at Page 3, lines 98–100, specifically teaches welding the spacer near its elongated ends.

Commercially available flexible steel double edge razor blades having an elongated central slot parallel to the cutting edges are arcuately flexed at tab portions at each end of the slot when firmly seated in double edge razors having manually operated mechanisms for opening and closing the cap portion. However, as shown in FIG. 4 of U.S. Pat. No. 3,708,879, the portions of the razor blades between the slot and the cutting edges are at least substantially flat.

Welding metal increases grain size of the metal about the weld, and the corrosion rate about the weld is high. When double edge razor blades are welded together at the tab portions, and the tab portions are thereafter arcuately bent in a razor as specifically taught in U.K. Pat. No. 772,532, a danger of stress-corrosion cracking is raised. Stress-corrosion cracking is failure by cracking under combined corrosion and applied and/or residual stress.

SUMMARY OF THE INVENTION

In accordance with the present invention, there is provided a shaving unit for a double edge safety razor comprising a first flexible member having a pair of opposite cutting edge sides. A second flexible member also having a pair of opposite cutting edge sides is located above the first member with the cutting edges of the second member being set back a slight distance from the cutting edges of the first member. Each one of the first and second members has a pair of transversely spaced end tabs. Means are provided between the first and second members for vertically spacing the first and second members. A transversely elongated aperture vertically extends through the shaving unit for locating the shaving unit in the safety razor. First means are provided between the aperture and the cutting edges to each side of the aperture for permanently connecting one of the first and second members to the spacing means, and second means are provided outwardly from the first connecting means in the direction of the tab ends of the first and second members between the aperture and the cutting edges to each side of the aperture for permanently connecting the other of the first and second members to the spacing means. A transversely elongated perforation is found in the spacer between the first and second connecting means and the cutting edges to each side of the aperture.

A shaving unit constructed in accordance with the present invention minimizes the stress-corrosion cracking problem by bonding the components of the shaving unit at surfaces which are at least substantially flat when the unit is seated in the razor.

DESCRIPTION OF SPECIFIC EMBODIMENTS

Figure 1:
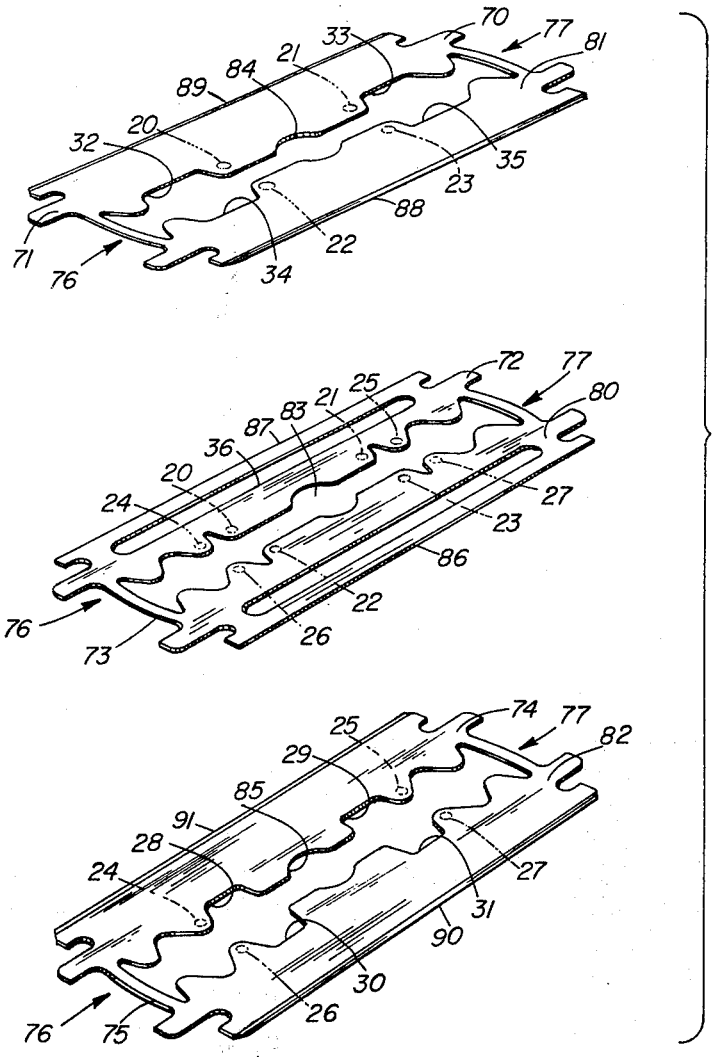
FIG. 1 is an exploded perspective view of an embodiment of a shaving unit constructed in accordance with the present invention.
Figure 2:
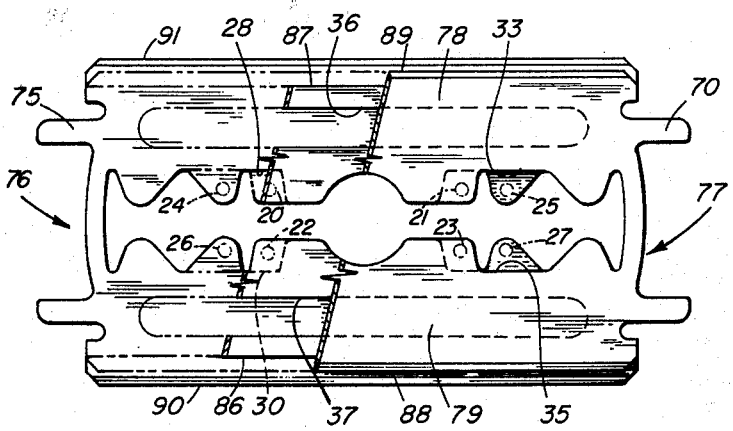
FIG. 2 is a top plan view of the shaving unit of FIG. 1 with portions of the component parts of the shaving unit cut away.

With reference to FIGS. 1 and 2, one representative embodiment of the present invention has first and second members 82, 81 in the form of double cutting edge razor blades, and means in the form of a spacer element 80 for vertically spacing the second member 81 from the first member 82. The top blade 81 and the spacer element 80 are permanently connected together by two welds 20, 21; 22, 23 diagrammatically represented by dashed circles on each side 78, 79 of transversely elongated apertures 83, 84 formed in the spacer element 80 and the top blade 81. The bottom blade 82 and the spacer element 80 are permanently connected together by two welds 24, 25; 26, 27 diagrammatically represented by dashed circles on each side 78, 79 of transversely elongated apertures 83, 85 formed in the spacer element 80 and the bottom blade 82. A transversely elongated perforation 36, 37 is formed in the spacer element 80 between the welds 20, 21, 24, 25; 22, 23, 26, 27 and the cutting edges 89, 91; 88, 90 to each side of the apertures 83–85.

The top blade 81 is cut away at 32–35 above the welds 24–27, and the bottom blade 82 is similarly cut away at 28–31 below the welds 20–23 to permit spot welding of the blades 81, 82 to the spacer element 80 in a single process step.

As clearly shown in FIG. 2, the cutting edges 88, 89 of the top blade 81 are set back a slight distance from the cutting edges 90, 91 of the bottom blade 82. The cutting edges 88, 89 on opposite sides of the top blade are parallel to the cutting edges 90, 91 on opposite sides of the bottom blade 82. The spacer element 80 has a pair of blunt surfaces 86, 87 set back a slight distance from the cutting edges 88, 89 of the top blade 81. The apertures 83–85 extend between end tab portions 72, 73; 70, 71; 74, 75 of the spacer element 80 and the blades 81, 82.

Figure 3:
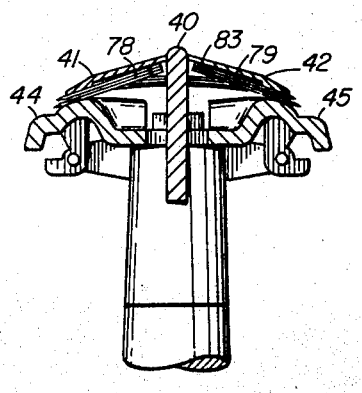
FIG. 3 is a side cross-sectional view of the shaving unit of FIGS. 1 and 2 seated in a sectional capped razor.

FIG. 3 shows the shaving unit seated and clamped in a double edge safety razor having a center-bar and stem assembly 40. The center-bar and stem assembly 40 is fitted through the apertures 83–85 to locate the shaving unit in the razor. A pair of sectional caps 41, 42 act to bias the shaving unit on a blade seat with the cutting edges of the blades 81, 82 tandemly arranged with respect to guard bar surfaces 44, 45 formed on the outer ends of the blade seat. FIG. 3 also shows the shaving unit portions 78, 79 between the tabs 70–75 in a flat state. However, the tab portions 70–75 are arcuately bent (not shown). As the shaving unit is being seated in a razor as shown in FIG. 3, there is a tendency for the strips of the spacer element 80 between its aperture 83 and the perforations 36, 37 to torsionally flex and thereby reduce the amount of force needed to seat the shaving unit.

The end tab portions 72, 73; 70, 71; 74, 75 have cut out portions 76, 77 which reduce the cross-sectional area of the unit and thereby also reduce the amount of force needed to seat the unit in the razor.

The blades 81, 82 and the spacer element 80 can be composed of thin martensitic stainless steel commonly used for razor blades, or of any other flexible material suitable for double edge razor blades. The thickness of the blades 81, 82 and of the spacer 80 can be 0.0039 inches. The distance between the cutting edges of the top blade 81 can suitably be 0.832 inches when the distance between the cutting edges of the bottom blade is 0.870 inches. The distance between the blunt surfaces 86, 87 of the spacer element 80 can be 0.780 inches.

The components of shaving units can be bonded together by spot, projection, arc, laser or other welding techniques. The shaving unit portions 78, 79 alternatively can be bonded to opposite sides of the spacer by adhesives. Further, the spacer can be formed of a plastic material.

The embodiment shown in the figures has symmetrically beveled surfaces forming the cutting edges of the blades 81, 82. However, it is contemplated that the beveled cutting edge surfaces of one or both of the blades 81, 82 can be asymmetrically ground to increase the vertical distance between the cutting edges of the blades 81, 82.

The present invention contemplates more than two double edge razor blades with the cutting edges on each side of the unit tandemly arranged. The invention also contemplates an alternative embodiment wherein the bottom blade welds 24–27 are inboard of the top blade welds 20–23.

I clam:

1. A shaving unit for a double edge safety razor, said shaving unit comprising:

a. a first flexible member including a pair of transversely extending opposite sides, and a pair of spaced end tabs, each one of the first member opposite sides having a cutting edge;

b. a second flexible member including a pair of tansversely extending opposite sides, and a pair of spaced end tabs, each one of the second member opposite sides having a cutting edge, said second member being located above said first member with the cutting edges of said second member being positioned upwardly and inwardly of the cutting edges of said first member, and with the end tabs of said second member being positioned above the end tabs of said first member;

c. flexible means between said first member and said second member for spacing said second member from said first member;

d. a transversely elongated aperture between the tab ends of said shaving unit extending through said first member, said spacing means and said second member between the cutting edges of said first member and said second member for locating said shaving unit in said safety razor;

e. first weld means between said aperture and the cutting edges to each side of said aperture for permanently connecting only one of said first and second members to said spacing means;

f. second weld means between said first weld means and each one of the tab ends of said shaving unit and between said aperture and the cutting edges to each side of said aperture for permanently connecting only the other of said first and second members to said spacing means, said weld means being the only means connecting the blades to the spacing means; and g. a transversely elongated perforation in said spacing means between said first and second weld means and the cutting edges to each side of said aperture.

2. The shaving unit of claim 1 wherein the cutting edges of said first members and said second member are parallel.

3. The shaving unit of claim 2 wherein said first and second members are metallic members.

4. The shaving unit of claim 3 wherein said spacing means is a metallic component.

5. The shaving unit of claim 4 wherein said first and second weld means each comprises a plurality of welds.

6. The shaving unit of claim 4 wherein said first and second members are double cutting edge safety razor blades.

7. The shaving unit of claim 4 wherein said first weld means connects said second member to said spacing means, and said second weld means connects said first member to said spacing means.

8. The shaving unit of unit 1 wherein said first and second connecting means comprising a plurality of spot welds.

9. The shaving unit of claim 8 wherein said plurality of spot welds comprises a first plurality of four spot welds connecting said first member to said spacing means and a second plurality of four spot welds connecting said second member to said spacing means.

* * * * *